US005626092A

United States Patent [19]

Essén et al.

[11] Patent Number: 5,626,092

[45] Date of Patent: May 6, 1997

[54] WATER EQUILIBRATING ARRANGEMENT

[75] Inventors: Ray Essén; Tom Degerman; Anna-Lea Rimpelä ; Esko Immonen, all of Turku, Finland

[73] Assignee: Kvaerner Masa-Yards Oy, Helsinki, Finland

[21] Appl. No.: 598,153

[22] Filed: Feb. 7, 1996

[30] Foreign Application Priority Data

Feb. 8, 1995 [FI] Finland ..... 950557

[51] Int. Cl.[6] ..... B63B 25/08

[52] U.S. Cl. ..... 114/74 R; 114/125

[58] Field of Search ..... 114/74 R, 74 T, 114/74 A, 125

[56] References Cited

FOREIGN PATENT DOCUMENTS 29188 12/1957 Finland .
67058 9/1984 Finland .
2160846 7/1973 France .
9313886 12/1993 Germany .
331955 1/1971 Sweden .
2210333 6/1989 United Kingdom .

*Primary Examiner*—Jesus D. Sotelo
*Attorney, Agent, or Firm*—Smith-Hill and Bedell

[57] ABSTRACT

A water equilibrating arrangement for a marine vessel comprises a trough that is in fluid flow communication with first and second closed or closeable compartments that are separated by an essentially imperforate structure and a baffle that extends downward from the imperforate structure into the trough and defines a passage that provides fluid flow communication between the compartments. In the event that water enters one of the compartments due to damage to the vessel, water can flow rapidly into the other compartment for equilibrating water load in the two compartments. Flow of gas through the trough is prevented when a substantial portion of the trough is filled with a liquid or a flowable solid or semi-solid material.

19 Claims, 5 Drawing Sheets

WATER EQUILIBRATING ARRANGEMENT

BACKGROUND OF THE INVENTION

This invention relates to a water equilibrating arrangement in a sea-going vessel or the like.

If a sea-going vessel is provided with two side by side compartments, each of which may, in case of damage to the vessel, be filled with water, safety regulations require that water flowing into one of the compartments must also have access to the other compartment. This ensures that the water load will be uniformly distributed over the cross-section of the vessel. If this does not apply, the vessel could lose its stability and capsize.

There is no difficulty in designing compartments which allow water to flow from one compartment to another. However, there is also a requirement for certain compartments to be closed off in a gas-tight manner, for example in case of fire. Closing a compartment prevents the spread of fire and also allows the closed compartment to be filled with gas to choke the fire.

SUMMARY OF THE INVENTION

An object of the present invention is to provide a structure which not only allows large masses of water to flow from one compartment to another, but also makes it possible to prevent the spread of fire or gas from one compartment to another through passages provided for water flow.

In the description and the following claims, the terms "closed" and "closeable" used in relation to a compartment mean that the compartment is closed or may be closed in a sidewards direction. This does not exclude the possibility that the compartment is open upwards through possibly closeable air ducts or the like.

The present safety regulations require that, in case of damage to a vessel, a water mass flowing into one compartment should "instantaneously" provide an equilibrating action in a neighboring compartment. This means that if the equilibrating system were disabled and one compartment was filled with water to the highest level feasible, i.e. to the water level outside the ship, and the equilibrating system was then rendered operative, the equilibrating action must take place within a certain maximum time, for example 60 seconds. The value of 60 seconds is the standard for the present day application of the safety regulations. However, in different applications, the interpretation of the regulations may be different and furthermore the interpretation of these regulations may change in the future. Therefore, it will be appreciated that the value of 60 seconds is only a present day guideline which may change in the future.

In a water equilibrating arrangement according to the invention there is a flow trap between the two compartments. This trap has the same function as the liquid seal (or odor seal) of a sanitary installation. The trap does not normally have to function as a liquid seal, but there must be means provided or arranged to rapidly fill the trap with water or another suitable flowable material to seal the trap in a gas tight manner. An alternative flowable material may, for example, comprise foam material, e.g. a fire extinguishing foam, a gelatinous substance or a substance which, in a filling phase, flows relatively easily but, after a short time, for example due to heat, becomes gelatinous. A granular substance could also be used if it could rapidly fill or block the trap and provide sufficiently good gas tightness. It is only important that the trap can be filled sufficiently rapidly and that an acceptable gas tightness and/or a fire prevention function is achieved when the trap has been so filled.

The trap may advantageously comprise a trough, for example running in the direction of a partition, in particular a bulkhead or the like structure, between the compartments. Such a partition suitably extends downwardly into the trough along the length of the latter, with the trough opening into the two compartments on opposite sides of the partition. The bottom of the trough may conveniently be spaced at a distance from the lower edge of the partition so that a U-shaped flow duct is formed which passes around the lower portion of the partition. Such a structure takes up relatively little space and, being situated at the position of a partition, preferably a bulkhead or the like, between the compartments does not normally obstruct the mounting or use of any machinery or any device and does not substantially restrict the free space available within the compartments, for example for the installation of machinery.

The trap may be totally or to a considerable extent below the floor level of the compartments where there normally is sufficient space available. If there is not sufficient space below the floor level, the trap must be placed at least partly above the floor level. The effect of the position of the trap on the speed of the equilibrating action must be taken into account when dimensioning the trap.

The trap may, in its longitudinal direction, that is in the direction of any partition or bulkhead, be divided into several portions by transverse walls. In this case, changes in the trim of the vessel do not have any significant effect on the functioning of the trap as a liquid seal provided that the distance between the transverse walls is small enough. Transverse walls may also be utilized to improve the rigidity and stiffness of the trap structure and any structures attached thereto.

It is recommended to design the trap so that, when filled with liquid or other flowable medium, the trap is able to prevent through flow of gas between the compartments when the vessel has a heeling angle of at least 5°, preferably up to at least 10°. Such a trap is designed to function in the event of a possible cargo shift or other accident which would be likely to cause heelings of these magnitudes.

It is of advantage that the size of the cross-sectional area of a flow duct of the trap is at least substantially uniform at all flow positions through the trap between the compartments. This is favorable from the point of view of flow dynamics, because it eliminates flow speed fluctuations in the duct. Other arrangements are also possible. For instance if the cross-section of the trap is rectangular, the trap is relatively easy to manufacture and to fit into the other structures of the hull of the vessel.

The floor area available in the compartments in question may be enlarged by covering the opposite ends of the trap which open into the adjacent compartments, with grating structures. The ends of the trap should be so dimensioned that the total area of the grating openings of each grating structure is approximately equal to the smallest cross-sectional area of a flow duct of the trap. Dimensioned in this way the grating structures do not substantially slow down water flow between the compartments during a water equilibrating action.

If storage of a liquid of other flowable medium is provided at a level above the trap, the trap can be rapidly filled with an amount of the liquid or other flowable material sufficient to provide a gas-tight seal of the trap. If it is required to speed up the flow of the liquid or other flowable material into the trap, it is possible to make use of pressurized air, a pump, a compressor or some other suitable device for speeding up the flow of the stored substance. Water for filling up the trap may be taken, for instance, from the sea, from a pool, from a ballast tank or the like.

Means may also be provided for filling the compartments with a fire choking gas or with a corresponding fire preventing substance to improve the fire safety of the vessel. Such means are especially required in engine rooms.

BRIEF DESCRIPTION OF THE DRAWINGS

An embodiment of the invention will now be described, by way of example only, with particular reference to the accompanying drawings, in which.

DETAILED DESCRIPTION

Figure 1:
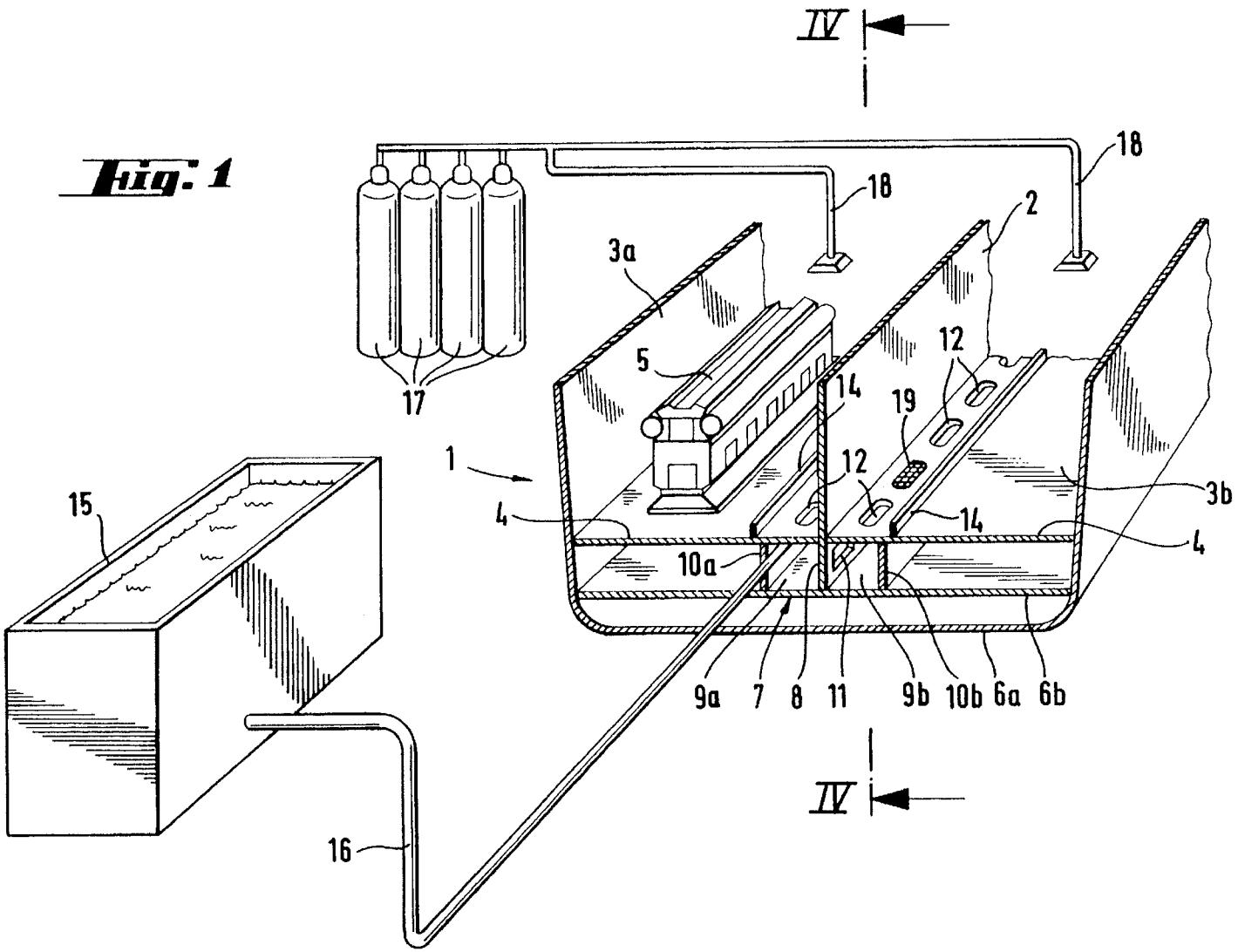
FIG. 1 schematically shows a water equilibrating arrangement according to the invention applied to the engine room of a marine vessel, FIG. 2 schematically illustrates the functioning of the arrangement shown in FIG. 1 in the event of an accident, FIG. 3 schematically illustrates the functioning of the arrangement shown in FIG. 1 in the event of a fire.

In the drawings, reference numeral 1 designates a floating vessel, e.g. a marine vessel, having a hull with two sides. The hull contains an engine room which is divided by a longitudinal partition in the form of a longitudinal bulkhead 2 into two closeable compartments 3*a* and 3*b* having a floor 4. The two compartments are at opposite sides of a central longitudinal plane of the vessel. One main engine 5 of the vessel is located in compartment 3*a* and another main engine (not shown so as to make the water equilibrating arrangement according to the invention more clearly visible) is located in compartment 3*b*. The vessel has a double bottom 6*a*, 6*b* and a trap 7 is disposed between the double bottom 6*a*, 6*b* and the floor 4 of the compartments 3*a* and 3*b*.

Above the floor 4, the bulkhead 2 is essentially imperforate, so as to prevent propagation of fire between the compartments 3*a* and 3*b*. The compartments 3*a* and 3*b* may be open upward, for example through ventilation ducts equipped with fire closure shutters.

The trap 7 is in the form of a rectangular trough having a horizontal base and longitudinal side walls that extend upward from the base to a rim at the top of the trough. The base of the trough is provided by the bottom 6*b* and the side walls by longitudinal plate structures 10*a* and 10*b* of the vessel. The longitudinal bulkhead 2 extends downward into the trough, where its lower portion 8, below the rim of the trough, divides the trough longitudinally into two portions 9*a* and 9*b*. In its lower portion 8, the bulkhead 2 is formed with large flow apertures 11 that provide fluid flow communication between the two portions 9*a* and 9*b*. The apertures 11 are positioned below the rim of the trough. The portions 9*a* and 9*b* open into the compartments 3*a* and 3*b* respectively through apertures 12. Accordingly, fluid is able to flow between the compartments 3*a* and 3*b* by way of the apertures 11 and 12 and the portions 9*a* and 9*b* of the trough. The lower portion 8 of the bulkhead 2 serves as a baffle that is integrally connected to the imperforate portion of the bulkhead and limits in the upward direction the space available for fluid flow between the portions 9*a* and 9*b*.

For safety reasons, the apertures 12 may be covered by gratings 19. The floor 4 may be provided with vertical shields 14 in the vicinity of the apertures 12 to prevent any substance in the trough from spreading or spilling into the compartments. This kind of shield is particularly required if the trap 7 is partially above the level of the floor 4. Alternatively, only the edges of the apertures 12 need to be provided with upwardly projecting collars for the same purpose.

The trap 7 is connected to a substance container 15, for example, a ballast tank or another tank, a pool or the like, from which the trough may be rapidly filled via a tube 16. For safety reasons, it is preferred that the container 15 should always contain enough substance to completely fill up the trough. It is advantageous for the container 15 to be at a clearly higher level than the trap 7 so that the trough is filled by gravity flow from the container. Although not shown in FIG. 1, devices or systems for speeding up the filling process may be provided. Also, a closure valve should be provided in the tube 16. Level indicators, control devices or other devices may also be required. Pressure vessels 17 containing a pressurized substance, such as carbon dioxide, for extinguishing fires, may also be provided, the pressure vessels being connected via tubes 18 to the closed compartment 3*a* or 3*b* or to both of them.

The apertures 11 and 12 are arranged so that they fit into the general hull structure of the vessel without weakening it. It is preferred for strength reasons that the lower portion 8 of the bulkhead 2 extend to the bottom of the trough and be firmly attached to the bottom 6*b* and that the apertures 11 be formed above the lower edge of the bulkhead. Alternatively, or in addition, to forming the apertures 11 in the partition or bulkhead above the lower edge thereof, the bulkhead 2 may terminate above the bottom of the trough defined by the plate structures 10*a* and 10*b* and the bottom 6*a* to provide a gap that allows fluid flow communication between the portions 9*a* and 9*b*.

FIG. 1 illustrates a normal situation when there is no immediate need to fill up the trap 7 with water or some other non-gaseous flowable material. However, the arrangement is at full readiness all the time for using the trap 7 in an equilibrating action as well as to prevent the spread of fire.

Figure 2:
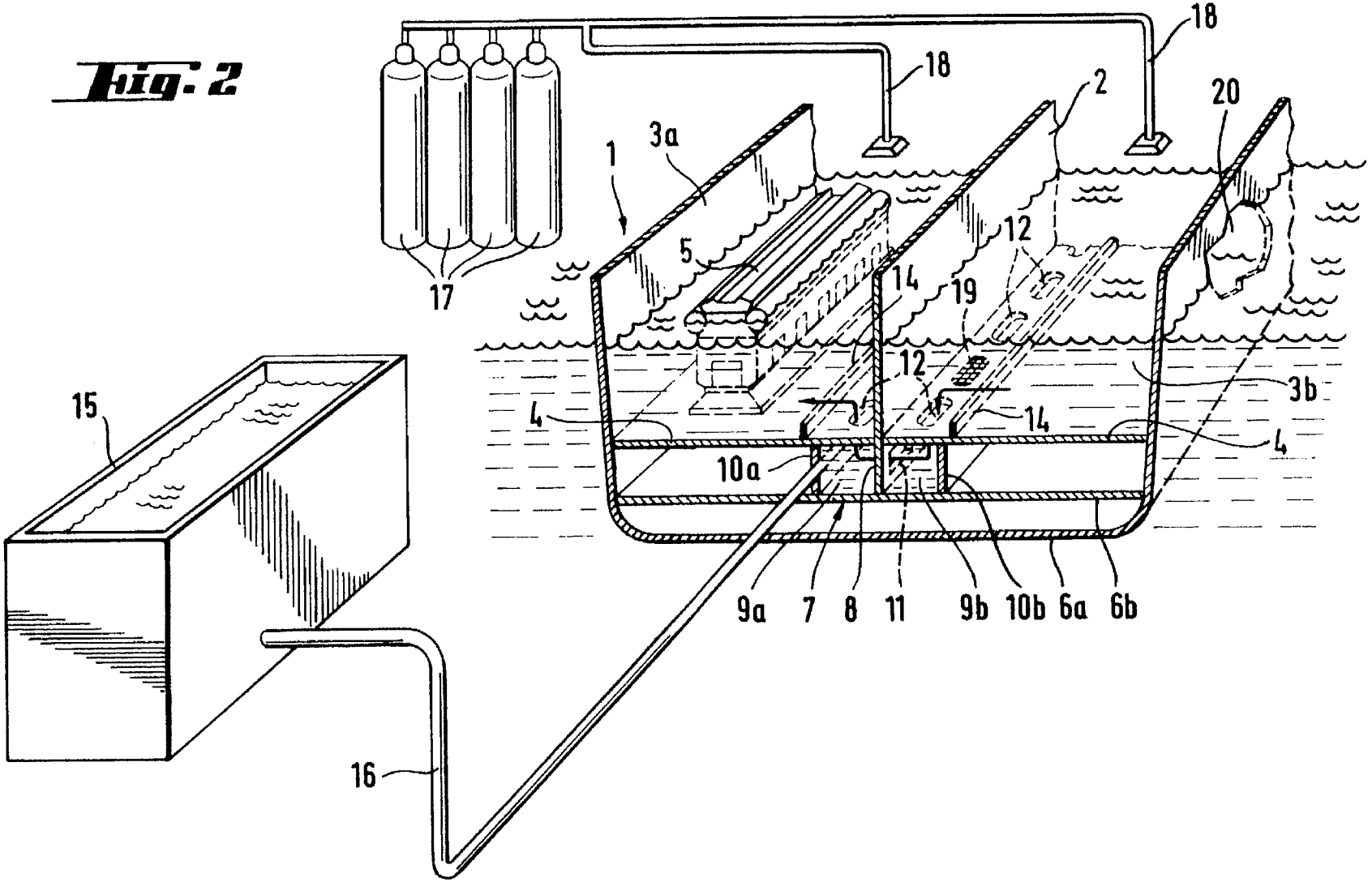

FIG. 2 shows an accidental damage opening 20 in the outer side of the compartment 3*b*. Water flowing in through the opening 20 to the compartment 3*b* flows through the trap 7 and into the compartment 3*b*. Because the total cross-sectional area of the flow passage defined by the trap 7 is large, the flow of water from the damaged compartment 3*b* to the compartment 3*a* takes place rapidly and the stability of the vessel is preserved.

Figure 3:
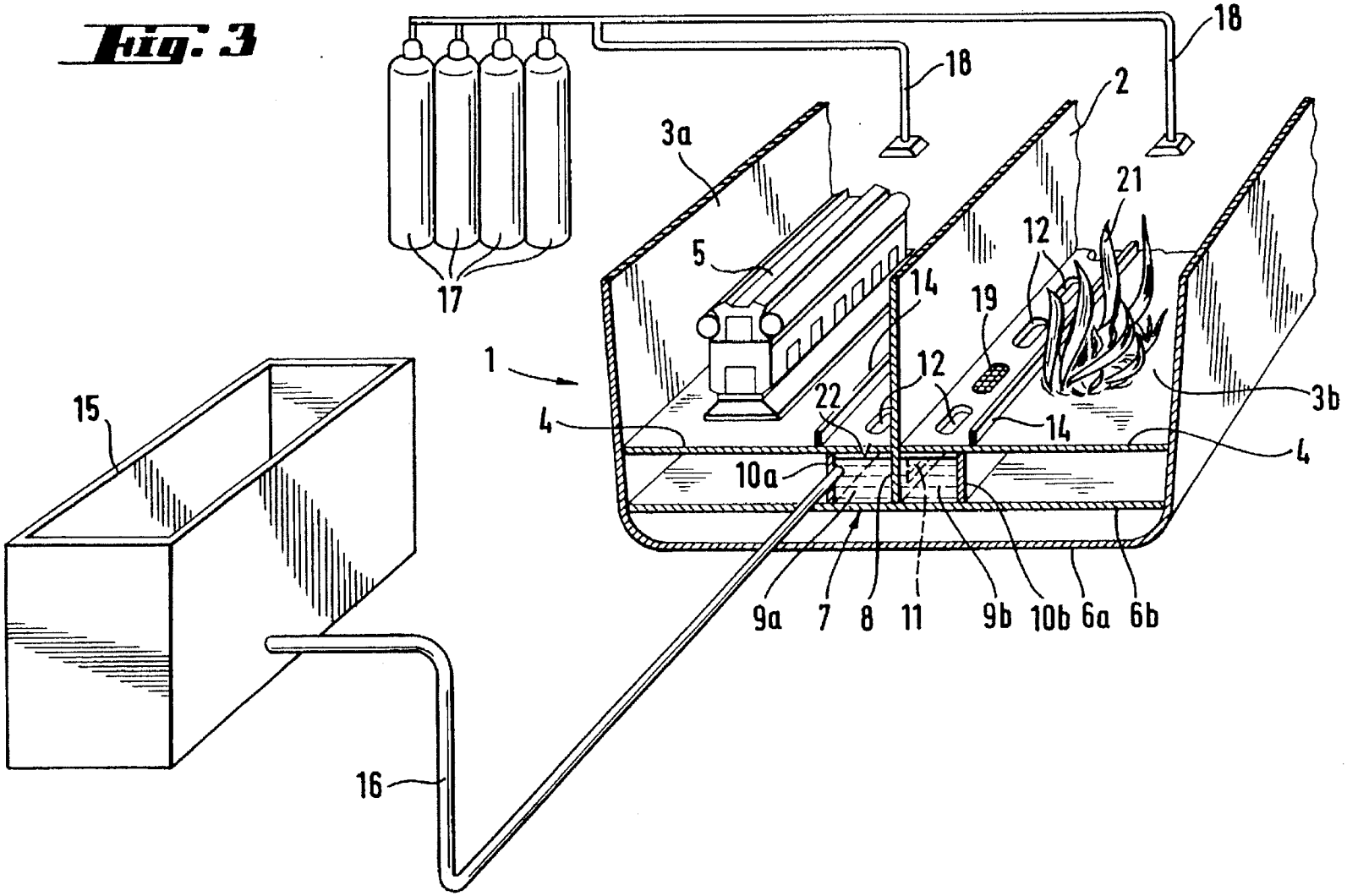

FIG. 3 shows a fire 21 in the compartment 3*b*. In this case the trap 7 is filled at least approximately to the height of the level of the floor 4 with water from the container 15 through the tube 16. It is important that the water level 22 is above the upper edges of the apertures 11 in order to achieve liquid sealing. Carbon dioxide or some other suitable substance is supplied from the pressure vessels 17 through the tube 18 to the compartment 3*b* to extinguish the fire.

Figure 4:
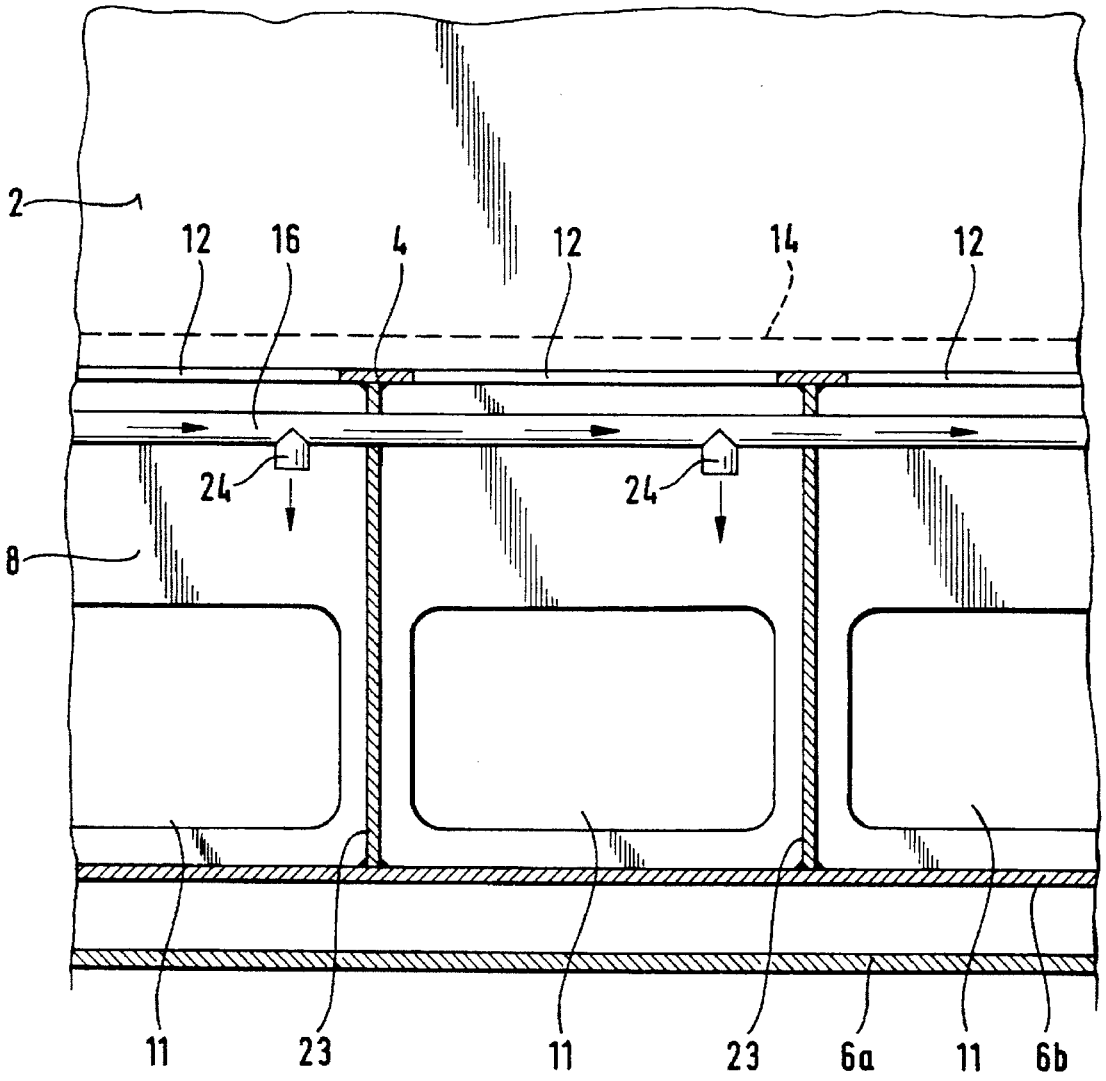
FIG. 4 is section taken on the line IV—IV of FIG. 1, and FIG. 5 schematically illustrates a modified form of the water equilibrating arrangement shown in FIGS. 1–4.

FIG. 4 shows the apertures 11 which are located in the lower portion 8 of the bulkhead 2 in the vicinity of the bottom 6*b* of the trap 7. The length of the trap 7 is divided into segments by transverse walls 23 which are spaced apart from 1 to 5 meters, preferably from 2 to 3 meters. The total area of the apertures 11 should be sufficiently great to enable a sufficiently fast water equilibrating action to be achieved. The upper edges of the apertures 11 are at a sufficiently low level for a safe liquid sealing function to be obtained with only a relatively small amount of water.

The filling tube 16 of the trap 7 is installed so that the tube 16 is provided with outflow apertures or tubes 24 in each of the spaces between the transverse walls 23. By providing the transverse walls 23, the water or other substance used to fill the trap 7 cannot flow in the longitudinal direction of the vessel 1. Therefore, the liquid sealing function of the trap arrangement is maintained even if the trim position of the vessel 1 changes.

Figure 5:
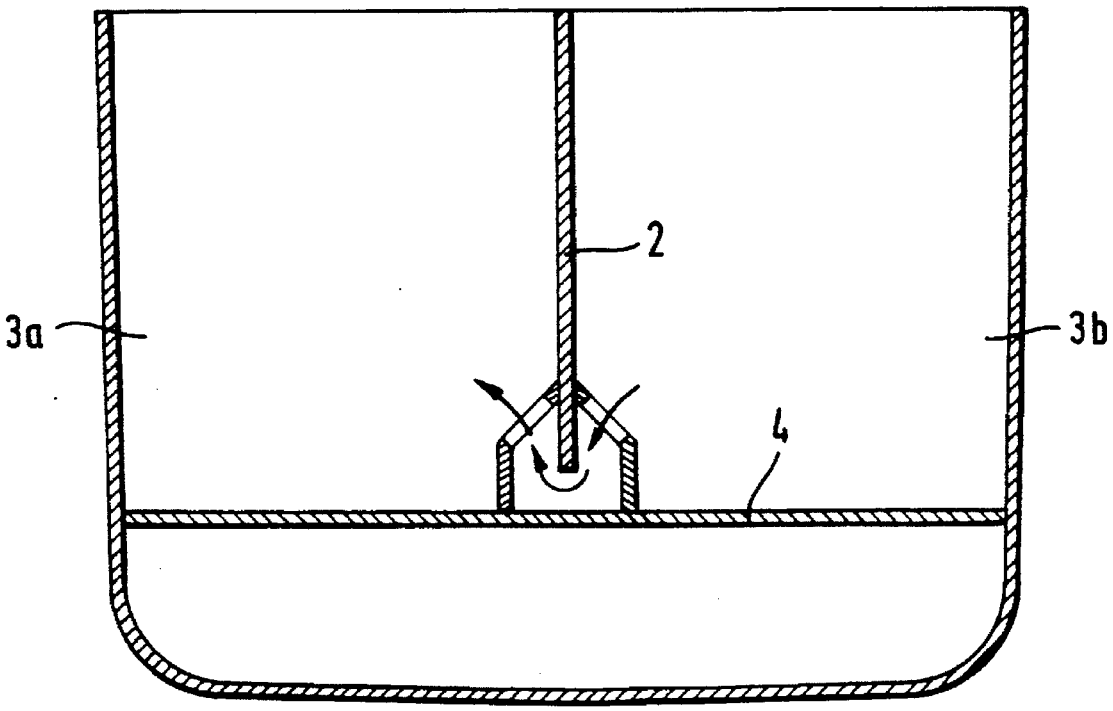

FIG. 5 illustrates a modified water equilibrating arrangement in which the trough is defined by the floor 4 of the compartments 3*a* and 3*b* and two vertical walls that extend upwards from the floor 4. In the arrangement shown in FIG. 5, the bulkhead 2 extends downward into the trough but does not extend as far as the floor 4. A gap for flow of water is formed between the bottom edge of the bulkhead and the base of the trough.

The invention is not to be considered as being limited to the embodiment illustrated since several variations thereof are feasible including variations which have features equivalent to, but not necessarily literally within the meaning of, features in any of the following claims. It will of course be appreciated that the invention is not restricted to use with two compartments that are separated by a single imperforate bulkhead, but is applicable in general to two compartments that are separated across the vessel by a structure that would prevent an equilibrating flow of water between the compartments if it were not for the equilibrating arrangement according to the invention. For example, the invention is applicable to two compartments that have a third compartment therebetween, where the trap extends under the third compartment.

We claim:

1. A water equilibrating arrangement for a marine vessel having a first substantially closed or closeable compartment that is subject to being at least partly filled with water in case of damage to the vessel, a second substantially closed or closeable compartment, and an essentially imperforate structure separating the first and second compartments, said water equilibrating arrangement comprising means defining a trough that is in fluid flow communication with the first and second compartments, and baffle means that extend downward from said structure into the trough and define at least one passage that provides fluid flow communication between the first and second compartments, whereby water can flow rapidly from the first compartment into the second compartment for equilibrating water load in the first and second compartments and flow of gas through the trough is prevented when a substantial portion of the trough is filled with a flowable material.

2. An arrangement according to claim 1, wherein the first and second compartments each have a floor and the trough is at least partly below the floor.

3. An arrangement according to claim 1, wherein the trough and the baffle means are so dimensioned that in the event of entry of water into the first compartment in case of damage to the vessel, an equilibrating action takes place within a time stipulated by applicable safety regulations.

4. An arrangement according to claim 1, wherein said structure comprises a wall and the baffle means extend downward from said wall over the length of the trough, and the trough opens into the first and second compartments on opposite respective sides of the wall.

5. An arrangement according to claim 1, wherein said trough is divided into length segments by transverse walls that are spaced apart longitudinally of the trough.

6. An arrangement according to claim 1, wherein the trough and the baffle means are dimensioned so that when the trough is filled with the flowable material, it prevents flow of gas through the trough when the vessel is heeled over at an angle of at least 5°, preferably at least 10°.

7. An arrangement according to claim 1, wherein the trough and the baffle means define at least one flow duct that extends between the first and second compartments, and cross-sectional area of the flow duct is at least substantially uniform over length of the flow duct.

8. An arrangement according to claim 1, wherein the trough and the baffle means define at least one flow duct that extends between the first and second compartments and debouches into the first and second compartments at respective end apertures, and the end apertures are covered with respective grating structures each having a total open area approximately equal to minimum cross-sectional area of the flow duct between said end apertures.

9. A marine vessel comprising:

means defining a first substantially closed or closeable compartment that is subject to being at least partly filled with water in case of damage to the vessel and a second substantially closed or closeable compartment and an essentially imperforate structure separating the first and second compartments, a water equilibrating arrangement between the first and second compartments, said water equilibrating arrangement comprising means defining a trough that is in fluid flow communication with the first and second compartments, and baffle means that extend downward from said structure into the trough and define at least one passage that provides fluid flow communication between the first and second compartments, whereby water can flow rapidly from the first compartment into the second compartment for equilibrating water load in the first and second compartments and flow of gas through the trough is prevented when a substantial portion of the trough is filled with a flowable material.

10. An arrangement according to claim 9, wherein the first and second compartments each have a floor and the trough is at least partly below the floor.

11. A marine vessel according to claim 9, wherein the trough and the baffle means are so dimensioned that in the event of entry of water into the first compartment in case of damage to the vessel, an equilibrating action takes place within a time stipulated by applicable safety regulations.

12. A marine vessel according to claim 9, wherein said structure comprises a wall and the baffle means extend downward from said wall over the length of the trough, and the trough opens into the first and second compartments on opposite respective sides of the wall.

13. A marine vessel according to claim 9, wherein said trough is divided into length segments by transverse walls that are spaced apart longitudinally of the trough.

14. A marine vessel according to claim 9, wherein the trough and the baffle means are dimensioned so that when the trough is filled with the flowable material, it prevents flow of gas through the trough when the vessel is heeled over at an angle of at least 5°, preferably at least 10°.

15. A marine vessel according to claim 9, wherein the trough and the baffle means define at least one flow duct that extends between the first and second compartments, and cross-sectional area of the flow duct is at least substantially uniform over length of the flow duct.

16. A marine vessel according to claim 9, wherein the trough and the baffle means define at least one flow duct that extends between the first and second compartments and debouches into the first and second compartments at respective end apertures, and the end apertures are covered with respective grating structures each having a total open area approximately equal to minimum cross-sectional area of the flow duct between said end apertures.

17. A marine vessel according to claim 9, further comprising a container of water or other flowable material sufficient to fill the trough to a level for preventing flow of gas through the trough, and means for delivering said flowable material from the container to the trough.

18. A marine vessel according to claim 9, comprising means for introducing fire extinguishing material into the compartments.

19. A marine vessel according to claim 18, wherein the fire extinguishing material is a fire extinguishing gas.

* * * * *